US009927110B2

(12) United States Patent
Zhou et al.

(10) Patent No.: US 9,927,110 B2
(45) Date of Patent: Mar. 27, 2018

(54) REFRIGERATING APPARATUS

(71) Applicant: HEFEI HUALING CO., LTD., Hefei, Anhui (CN)

(72) Inventors: Jianjun Zhou, Anhui (CN); Huawei Zhang, Anhui (CN); Xianghai Pu, Anhui (CN); Mingfeng Xu, Anhui (CN)

(73) Assignee: HEFEI HUALING CO., LTD., Hefei, Anhui (CN)

( * ) Notice: Subject to any disclaimer, the term of this patent is extended or adjusted under 35 U.S.C. 154(b) by 0 days.

(21) Appl. No.: 15/108,291

(22) PCT Filed: Dec. 30, 2013

(86) PCT No.: PCT/CN2013/090919
§ 371 (c)(1),
(2) Date: Jun. 25, 2016

(87) PCT Pub. No.: WO2015/096176
PCT Pub. Date: Jul. 2, 2015

(65) Prior Publication Data

US 2016/0320041 A1 Nov. 3, 2016

(30) Foreign Application Priority Data

Dec. 25, 2013 (CN) ..... 2013 1 0727324

(51) Int. Cl.
*F21V 33/00* (2006.01)
*F21V 23/04* (2006.01)
(Continued)

(52) U.S. Cl.
CPC ..... *F21V 23/0492* (2013.01); *F21V 3/00* (2013.01); *F21V 33/0044* (2013.01);
(Continued)

(58) Field of Classification Search
CPC ..... F21V 33/00
(Continued)

(56) References Cited

U.S. PATENT DOCUMENTS 4,104,492 A * 8/1978 Pliml, Jr. ..... H01H 35/027 200/51.14
4,322,870 A * 4/1982 Lautenschlager ..... E05D 5/0246 16/235
(Continued)

FOREIGN PATENT DOCUMENTS

CN 201068694 Y 6/2008
CN 101302908 A 11/2008
(Continued)

OTHER PUBLICATIONS

China Patent Office, first Office action dated Jan. 4, 2015 in the prior-filed China patent application corresponding to the present US patent application.
(Continued)

*Primary Examiner* — Daniel Hess
(74) *Attorney, Agent, or Firm* — Kile Park Reed & Houtteman PLLC

(57) ABSTRACT

A refrigerating apparatus includes a cabinet body having an open top; a door body (2) disposed at the top of the cabinet body pivotably around a pivot shaft (421) so as to open and close the cabinet body; and a light assembly (3), disposed at a side of the door body (2) facing the cabinet body (2) and arranged adjacent to the pivot shaft (421), wherein the light assembly (3) includes a PCB (31), an LED light (32) and a gravity switch (33), both the LED light (32) and the gravity switch (33) are connected onto the PCB (31), and the gravity switch (33) is configured to be switched on to light the LED light (32) so as to light an interior of the cabinet body when the door body (2) opens the cabinet body, and switched off
(Continued)

to extinguish the LED light (32) when the door body (2) closes the cabinet body.

18 Claims, 7 Drawing Sheets

(51) Int. Cl.

| | |
|---|---|
| ***F25D 23/02*** | (2006.01) |
| ***F25D 27/00*** | (2006.01) |
| ***F21V 3/00*** | (2015.01) |
| ***F25D 21/04*** | (2006.01) |
| *F21Y 115/10* | (2016.01) |
| *F21W 131/305* | (2006.01) |

(52) U.S. Cl.
CPC ..... *F25D 21/04* (2013.01); *F25D 23/026* (2013.01); *F25D 27/00* (2013.01); *F21W 2131/305* (2013.01); *F21Y 2115/10* (2016.08)

(58) Field of Classification Search
USPC ..... 362/94, 154, 276
See application file for complete search history.

(56) References Cited

U.S. PATENT DOCUMENTS 4,754,376 A * 6/1988 Winslow ..... F21S 9/02 362/154
2006/0028820 A1* 2/2006 Fitzsimmons ..... A01K 97/06 362/276
2016/0320041 A1 11/2016 Zhou et al.

FOREIGN PATENT DOCUMENTS

| | | | |
|---|---|---|---|
| CN | 201826658 | U | 5/2011 |
| CN | 102170729 | A | 8/2011 |
| CN | 201966127 | U | 9/2011 |
| CN | 102230586 | A | 11/2011 |
| EP | 3088821 | A1 | 11/2016 |
| WO | WO 2015096176 | A1 | 7/2015 |

OTHER PUBLICATIONS

China Patent Office, second Office action dated Oct. 8, 2015 in the prior-filed China patent application corresponding to the present US patent application.
China Patent Office, third Office action dated Feb. 2, 2016 in the prior-filed China patent application corresponding to the present US patent application.
China Patent Office, International Search Report dated Sep. 30, 2014.
China Patent Office, Written Opinion of the International Searching Authority dated Sep. 30, 2014.
Canadian Intellectual Property Office, Office action dated Apr. 5, 2017 in the Canadian Counterpart patent application.

* cited by examiner

REFRIGERATING APPARATUS

FIELD

The present disclosure relates to a field of refrigerating apparatus, and more particularly to a refrigerating apparatus.

BACKGROUND

In the related art, a lighting lamp of a freezer usually adopts an incandescent lamp and a mechanical switch to turn on/off the incandescent lamp. However, the incandescent lamp has a large heat release, and the mechanical switch has a large size and noise as well as a low reliability.

SUMMARY

The present disclosure aims at solving at least one of the problems existing in the related art. Thus, one objective of the present disclosure is to provide a refrigerating apparatus, a light assembly of which has a small heat generation and noise, a high level of integration, a low noise and a low energy consumption, thus improving an overall performance of the refrigerating apparatus effectively.

The refrigerating apparatus according to the present disclosure includes: a cabinet body having an open top; a door body disposed at the top of the cabinet body pivotably around a pivot shaft so as to open and close the cabinet body; and a light assembly, disposed at a side of the door body facing the cabinet body and arranged adjacent to the pivot shaft, in which the light assembly includes a PCB, an LED light and a gravity switch, both the LED light and the gravity switch are connected onto the PCB, and the gravity switch is configured to be switched on to light the LED light so as to light an interior of the cabinet body when the door body opens the cabinet body, and switched off to extinguish the LED light when the door body closes the cabinet body.

With the refrigerating apparatus according to the present disclosure, the door body is provided with the light assembly having the LED light and the gravity switch, and the LED light has a gentle light and a small heat generation, so an electric energy of the refrigerating apparatus can be saved effectively. The gravity switch has a small size and a light weight, and the whole light assembly has a small noise and a high level of integration and reliability.

Specifically, the gravity switch includes: a casing connected onto the PCB; a first leading wire disposed through the casing and separated from the casing, in which the first leading wire is connected onto the PCB; and a rolling body rollingly disposed in the casing and configured as that the LED light is turned on when the door body opens the cabinet body and the rolling body is in contact with the first leading wire as well as the LED light is turned off when the door body closes the cabinet body and the rolling body is separated from the first leading wire.

Further, the casing is connected onto the PCB through a second leading wire, and the second leading wire and the first leading wire are spaced a part from each other in a length direction of the casing.

Optionally, a central axis of the casing along the length direction thereof is perpendicular to a central axis of the pivot shaft, and the first leading wire is disposed adjacent to the pivot shaft.

Further, the first leading wire is separated from the casing via a separating piece and the separating piece is disposed between the first leading wire and the casing.

Optionally, the separating piece is configured to be an insulating sleeve.

Optionally, the rolling body is configured to be a ball or a roller.

Optionally, the refrigerating apparatus further includes a cover body covering the light assembly.

Further, the LED light penetrates the cover body, the cover body is provided with a light-cover thereon, and the light-cover is arranged adjacent to the LED light.

Or optionally, the refrigerating apparatus further includes a light-cover arranged adjacent to the LED light and located at a first side of the LED light away from the pivot shaft.

Optionally, the door body is formed with an accommodating groove therein and the light assembly is accommodated in the accommodating groove.

Optionally, the LED light has a second side facing the pivot shaft and connected onto the PCB obliquely.

Further, the refrigerating apparatus further includes a delay device connected with the LED light.

Optionally, the delay device is configured to be a capacitor and the capacitor is connected onto the PCB.

Optionally, a plurality of the LED lights is spaced apart from one another on the PCB.

Further, the plurality of the LED lights is arranged in two rows in a direction of the PCB parallel to the pivot shaft, and the two rows of the LED lights are in a one-to-one or staggered arrangement.

Optionally, the door body has an angle relative to an upper surface of the cabinet body ranging from 0° to 90°.

Specifically, the door body is rotatably disposed on the cabinet body via a hinge device, and the hinge device includes: a first hinge disposed on the top of the cabinet body and having a pivoting hole; and a second hinge disposed at the door body and having the pivot shaft, in which the pivot shaft cooperates with the pivoting hole so that the door body pivots on the pivot shaft, and the second hinge cooperates with the first hinge via a limiting structure so that the door body pivots on the cabinet body from 0° to 90°.

Optionally, the first hinge includes two side walls spaced apart from each other, two pivoting holes are formed in the two side walls respectively, and the pivot shaft has two ends penetrating the two pivoting holes respectively.

Specifically, the limiting structure includes a first limiting piece disposed to the first hinge; and a second limiting piece disposed to the second hinge and cooperating with the first limiting piece so that the second hinge pivots on the pivot shaft from 0° to 90° relative to the first hinge.

Optionally, the first limiting piece is configured to be a limiting hole and two limiting holes are provided in the two side walls respectively, and the second limiting piece is configured to be a limiting column and the limiting column has two ends penetrating the two limiting holes respectively.

Further, the limiting hole is configured to be an arc hole and the limiting hole is arranged coaxially with the pivot shaft.

Further, a supporting structure is disposed between the first hinge and the second hinge, and the supporting structure includes: a spring having a first end away from the limiting column connected into the first hinge; a supporting piece having a first end penetrating the spring and a second end connected with the limiting column; and a supporting plate disposed onto the supporting piece and having a side surface adjacent to the spring abutting against a second end of the spring adjacent to the limiting column.

Furthermore, the side surface of the supporting plate adjacent to the spring is provided with a positioning column and the spring is fitted over the positioning column.

Optionally, the first hinge is provided with a base therein and the first end of the spring away from the limiting column is connected onto the base.

Optionally, a plurality of light assemblies is arranged on the door body and spaced apart from one another.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

REFERENCE NUMERAL

Figure 1:
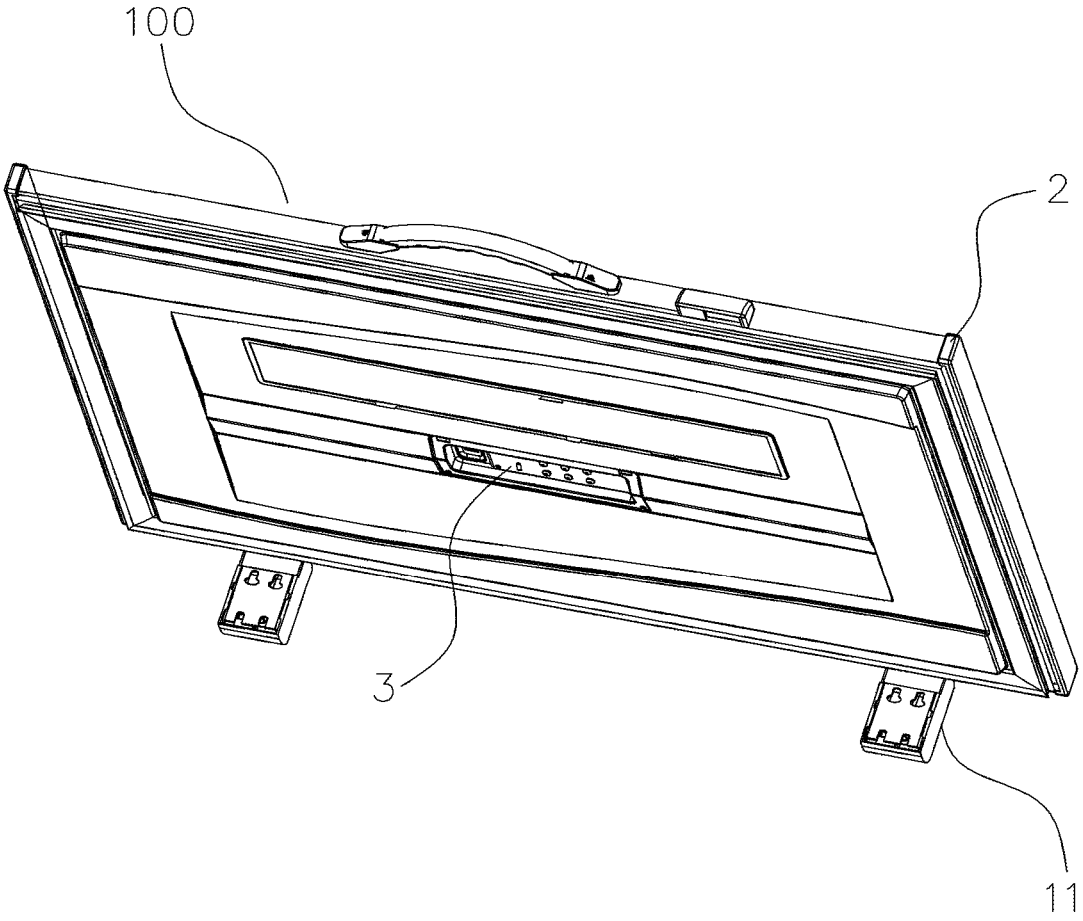
FIG. 1 is a schematic view of a door body of the refrigerating apparatus according to an embodiment of the present disclosure.

100: refrigerating apparatus;
2: door body;
3: light assembly; 31: PCB; 32: LED light;
33: gravity switch; 331: casing; 332: first leading wire;
333: rolling body; 334: second leading wire; 335: insulator
4: hinge device;
41: first hinge; 411: side wall; 4111: pivoting hole; 4112: limiting hole;
412: spring; 413: base; 4131: supporting hole;
42: second hinge; 421: pivot shaft; 422: hinge wall; 423: limiting column;
424: supporting piece; 4241: supporting plate; 4242: positioning column;

DETAILED DESCRIPTION

Embodiments of the present disclosure will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present disclosure, but shall not be construed to limit the present disclosure.

In the descriptions of the present disclosure, it is to be understood that terms such as "central", "transverse", "length", "width", "upper", "lower", "front", "rear", "left", "right", "vertical", "horizontal", "top", "bottom", "inner", "outer" and "axial" should be construed to refer to the orientation or position as described or as shown in the drawings under discussion.

These relative terms are for convenience of description and do not require that the present disclosure be constructed or operated in a particular orientation, thus shall not be construed to limit the present disclosure. In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, "a plurality of" means two or more than two, unless specified otherwise.

In the description of the present disclosure, it should be understood that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present disclosure.

A refrigerating apparatus 100 according to embodiments of the present disclosure will be described referring to FIG. 1 to FIG. 10 in the following, and the refrigerating apparatus 100 may be a horizontal freezer. In the following description of the present application, the refrigerating apparatus 100 is specified taking the horizontal freezer as an example. Certainly, it can be understood that the refrigerating apparatus 100 may further be a horizontal refrigerator.

Figure 2:
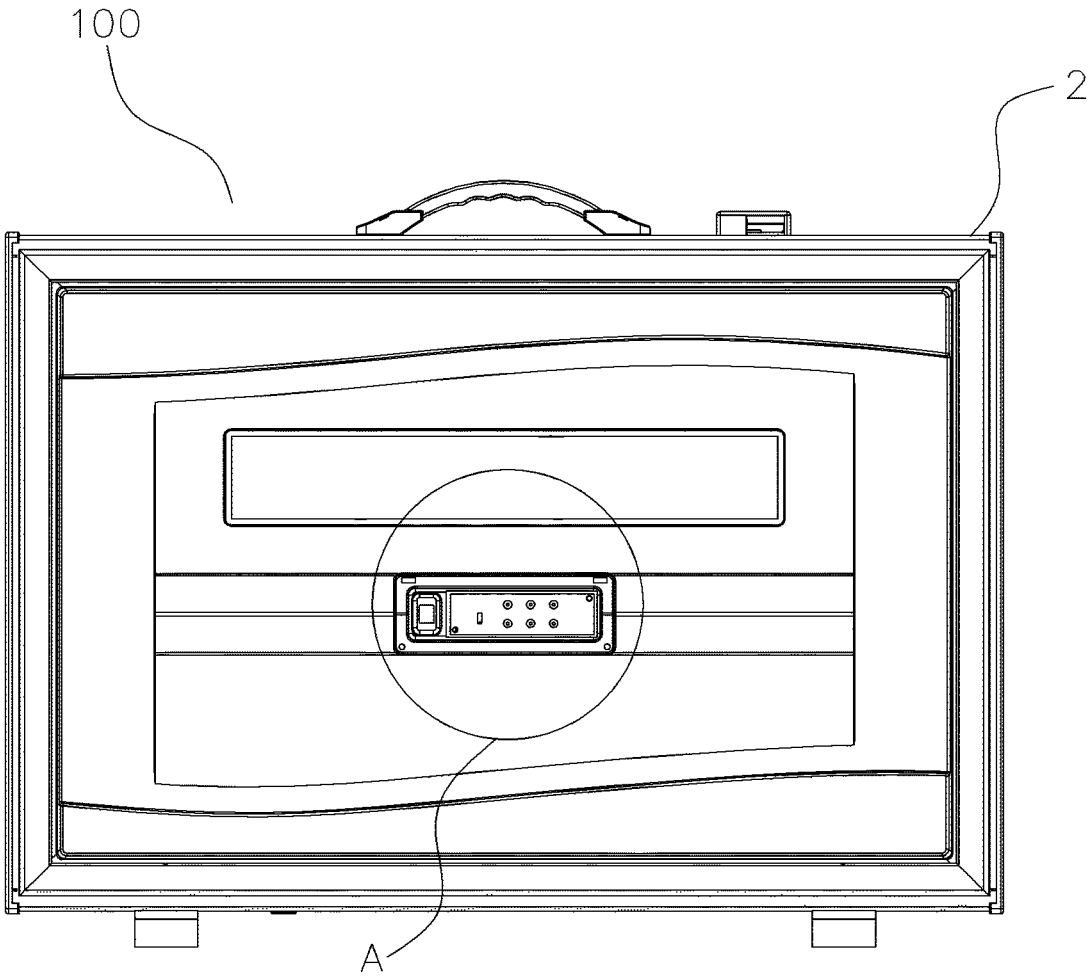
FIG. 2 is a front view of the door body shown in FIG. 1.
Figure 3:
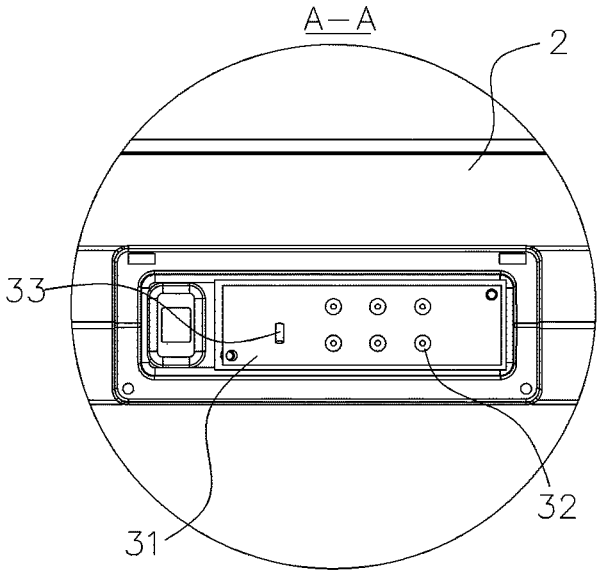
FIG. 3 is an enlarged view of a portion "A" circled in FIG. 2.

As shown in FIG. 1 to FIG. 3, the refrigerating apparatus 100 according to embodiments of the present disclosure includes: a cabinet body (not shown in the figures), a door body 2 and a light assembly 3. The cabinet body has an open top, and the door body 2 is disposed at the top of the cabinet body pivotably around a pivot shaft 421 so as to open and close the cabinet body.

In an example of the present disclosure, the cabinet body may be configured to be substantially of a cuboid shape and have the open top. The door body 2 is disposed at the top of the cabinet body and defines an accommodating space together with the cabinet body, foods or goods to be frozen or refrigerated may be put into the accommodating space. A first end of the door body 2 (such as a lower end shown in FIG. 1) may be connected to the top of the cabinet body via a hinge device 4, the hinge device 4 includes a pivot shaft 421, a central axis of the pivot shaft 421 is parallel to a line an edge of the lower end of the door body 2 located; a second end of the door body 2 (such as an upper end shown in FIG. 1) may pivot on the central axis of the pivot shaft 421. The door body 2 may be pivoted upwards to open the cabinet body when the foods or goods in the accommodating space need to be taken out.

The light assembly 3 is disposed at a side of the door body 2 facing the cabinet body. Referring to FIG. 1 and FIG. 2, when the door body 2 closes the cabinet body, the light assembly 3 is disposed at a surface of the door body 2 located in the accommodating space, i.e. the light assembly 3 is located at a lower surface of the door body 2 in a closed state; when the door body 2 opens the cabinet body, the light assembly 3 is disposed at the surface of the door body 2 facing the accommodating space, and at this time the light assembly 3 is turned on and can light the accommodating space, thus a user can see the foods or goods in the accommodating space clearly and take out the foods or goods needed or put the foods or goods in the accommodating space conveniently.

The light assembly 3 is arranged adjacent to the pivot shaft 421. As shown in FIG. 2, when the door body 2 is in an open state, the light assembly 3 may be disposed to a side of the door body 2 adjacent to the accommodating space (such as a middle and lower side shown in FIG. 2), such that the light assembly 3 can light an interior of the cabinet body better and provide a convenience for the users greatly.

Figure 4:
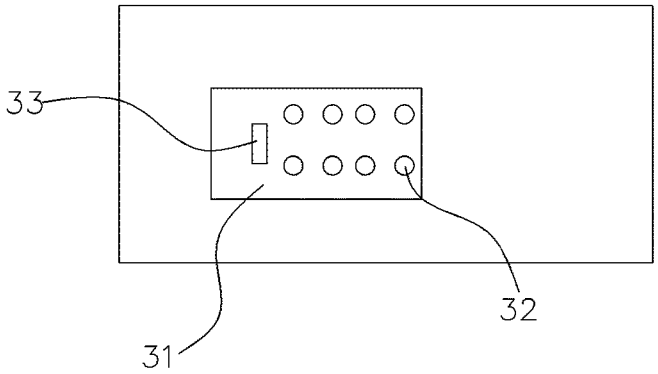
FIG. 4 is a schematic view of a light assembly of the refrigerating apparatus according to another embodiment of the present disclosure.
Figure 5:
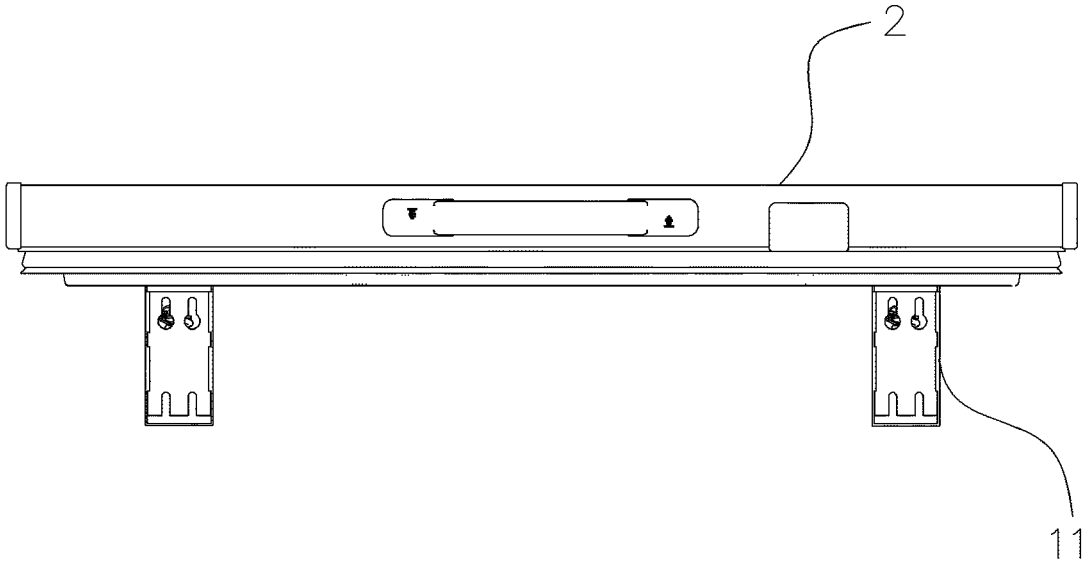
FIG. 5 is a top view of the door body shown in FIG. 1.

Referring to FIG. 3 and FIG. 4, the light assembly 3 includes a PCB 31 (Printed Circuit Board, an important electronic component, a supporting body of an electronic element, and a provider of an electronic connection of the electronic elements), an LED light 32 (light emitting diode, a solid semiconductor element which can transform electric power to visible light) and a gravity switch 33, both the LED light 32 and the gravity switch 33 are connected onto the PCB 31, and the gravity switch 33 is configured to be switched on to light the LED light so as to light the interior of the cabinet body 2 when the door body 2 opens the cabinet body, and switched off to extinguish the LED light when the door body 2 closes the cabinet body.

In the examples shown in FIG. 3 and FIG. 4, the PCB 31 is configured to be a substantially rectangular plate, and the gravity switch 33 and the LED light 32 are connected onto the PCB 31 and spaced apart from each other. When the user opens the door body 2 upwards, the gravity switch 33 is switched on and circuits on the PCB 31 are conducted to light the LED light 32; when the user closes the door body 2, the gravity switch 33 is switched off and circuits on the PCB 31 are disconnected to extinguish the LED light.

With the refrigerating apparatus 100 according to embodiments of the present disclosure, the door body is provided with the light assembly 3 having the LED light 32 and the gravity switch 33, and the LED light 32 has a gentle light and a small heat generation, so an electric energy of the refrigerating apparatus 100 for example the horizontal freezer can be saved effectively. The gravity switch 33 has a small size and a light weight, and the whole light assembly 3 has a small noise and a high level of integration and reliability.

Figure 6:
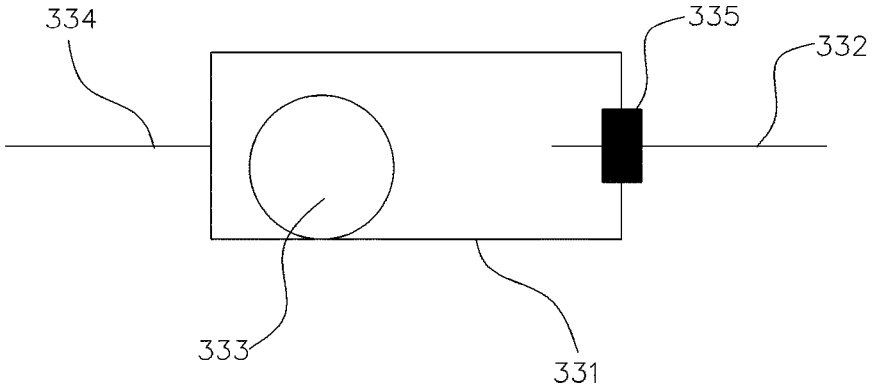
FIG. 6 is a schematic view of a gravity switch of the light assembly according to an embodiment of the present disclosure.

In an embodiment of the present disclosure, as shown in FIG. 6, the gravity switch 33 includes a casing 331, a first leading wire 332 and a rolling body 333, the casing 331 being connected onto the PCB 31. The first leading wire 332 is disposed through the casing 331 and separated from the casing 331, and the first leading wire 332 is connected onto the PCB 31. The rolling body 333 is rollingly disposed in the casing 331 and is configured as that the LED light 32 is turned on when the door body 2 opens the cabinet body and the rolling body 333 is in contact with the first leading wire 332, and the LED light 32 is turned off when the door body 2 closes the cabinet body and the rolling body 333 is separated from the first leading wire 332.

In the examples shown in FIG. 6, the casing 331 is configured to be a substantially cylindrical shape and defines a rolling space therein, and the rolling body 333 may be placed in the rolling space and roll in the rolling space. The first leading wire 332 has a first end (such as a left end shown in FIG. 6) inserted into the rolling space through a side wall of the casing 311 and a second end connected onto the PCB 31. The first leading wire 332 is not in contact with the casing 331, the casing 331 is also connected onto the PCB 31, and the rolling body 333 is in contact with the casing 331 all the time. When the door body 2 opens the cabinet body, the rolling body 333 moves rightwards to be in contact with the left end of the first leading wire 332, such that the casing 331 is conducted with the first leading wire 332 and the gravity switch 33 is switched on, thus the LED light 32 on the PCB 31 is turned on; when the door body 2 closes the cabinet body, the rolling body 333 moves leftwards to be separated from the left end of the first leading wire 332, such that the casing 331 is disconnected with the first leading wire 332 and the gravity switch 33 is switched off, thus the LED light 32 on the PCB 31 is turned off. Optionally, the rolling body 333 is configured to be a ball or a roller and the like.

Further, the casing 331 is connected onto the PCB 31 via a second leading wire, and the second leading wire and the first leading wire 332 are spaced apart from each other in a length direction of the casing 331. Referring to FIG. 6, the second leading wire is disposed to a left end of the casing 33. Specifically, a right end of the second leading wire is connected onto a left side wall of the casing 331, and a left end of the second leading wire is connected onto the PCB 31. Optionally, the second leading wire and the casing 331 are formed integrally, the second leading wire is disposed through a right side wall of the casing 331 herein, the first leading wire 332 and the second leading wire are spaced apart from each other in a left and right direction, and the rolling body 333 such as the ball can roll back and forth between the first leading wire 332 and the second leading wire.

Optionally, a central axis of the casing 331 along the length direction thereof is perpendicular to a central axis of the pivot shaft 421, and the first leading wire 332 is disposed adjacent to the pivot shaft 421. As shown in FIG. 1 to FIG. 3, a central axis of the cylindrical gravity switch 33 is arranged substantially perpendicular to the central axis of the pivot shaft 421. When the door body 2 opens the cabinet body, the ball in the casing 331 moves towards the first leading wire 332 under its own gravity and to be in contact with the first leading wire 332, such that the first leading wire 332 is conducted with the second leading wire and the LED light 32 on the PCB 31 is turned on; when the door body 2 closes the cabinet body, the ball in the casing 331 moves towards the second leading wire under its own gravity, such that the ball is separated from the first leading wire 332 and the first leading wire 332 is disconnected with the second leading wire, thus the LED light 32 on the PCB 31 is turned off. Certainly, the present disclosure is not construed to this, the gravity switch 33 may be also disposed on the door body 2 obliquely and herein an angle between the gravity switch 33 and the pivot shaft 421 is not 90° (not shown in the figures).

Further, the first leading wire 332 is separated from the casing 331 via a separating piece and the separating piece is disposed between the first leading wire 332 and the casing 331. Optionally, the separating piece is configured to be an insulating sleeve. Referring to FIG. 6, the insulating sleeve is fitted over a periphery of the first leading wire 332, the first leading wire 332 may be disposed coaxially with the insulating sleeve. A through hole along the left and right direction may be provided in the right side wall of the casing 331, and an outer peripheral wall of the insulating sleeve is formed as a shape matched with a shape of an inner peripheral wall of the through hole. e After the first leading wire 332 and insulating sleeve are mounted together, the insulating sleeve may be mounted in the through hole of the casing 331, thus separating the first leading wire 332 from the casing 331 effectively, preventing the first leading wire 332 and the casing 331 from a direct contact, which is simple in structure and convenient to mount.

In an embodiment of the present disclosure, the refrigerating apparatus 100 further includes a cover body (not shown in the figures) covering the light assembly 3. In an example of the present disclosure, a side of the cover body is open, when the light assembly 3 is mounted onto the door body 2, the cover body may be covered on the light assembly 3. Thus, by disposing the cover body, it can be effectively prevented that a condensation phenomenon appears on the light assembly 3 when the door body is opened, and the PCB 31 is avoided being damaged by the condensation water, such that the service life of the light assembly 3 is prolonged and the light emitted by the LED light 32 penetrating through the cover body is gentler.

Further, the LED light 32 penetrates the cover body, the cover body is provided with a light-cover thereon, and the light-cover is arranged adjacent to the LED light 32. Specifically, the cover body is formed with a through mounting hole, the LED light 32 may extend out of the cover body through the mounting hole, and the light-cover is disposed out of the cover body and arranged adjacent to the mounting hole. Optionally, the light-cover may be disposed at a side of the LED light 32 away from the pivot shaft 421, such that the light emitted by the LED light 32 can light the interior of the cabinet body better and the light emitted by the LED light 32 can be prevented from entering into people's eyes directly under an action of the light-cover. Optionally, an inner surface of the light-cover may be formed as a curved surface such as an arc surface.

Certainly, the present disclosure is not construed to this. In other embodiments of the present disclosure, the refrigerating apparatus 100 further includes a light-cover arranged adjacent to the LED light 32 and located at the first side of the LED light 32 away from the pivot shaft 421. In an example of the present disclosure, when the light assembly 3 is mounted onto the door body 2, the light-cover is arranged adjacent to the LED light 32 and at the side of the LED light 32 away from the pivot shaft 421, such that the light emitted by the LED light 32 can light the interior of the cabinet body better and the light emitted by the LED light 32 can be prevented from entering into people's eyes directly.

Optionally, the door body 2 is formed with an accommodating groove therein and the light assembly 3 is accommodated in the accommodating groove. In the example of FIG. 1 and FIG. 2, the door body 2 is formed with the accommodating groove concaved inwards, the light assembly 3 is substantially in the shape of rectangle and the accommodating groove is also substantially in the shape of rectangle. When the light assembly 3 is placed in the accommodating groove, the light assembly 3 may be connected to an inner wall of the accommodating groove via screws and then be covered by the cover body. The door body 2 may be formed with a mounting groove where corresponding to a position of the accommodating groove, the mounting groove is communicated with the accommodating groove and has a lager cross-sectional area than the accommodating groove, and the cover body may be connected in the mounting groove via a snap.

Optionally, the LED light 32 has a second side facing the pivot shaft 421 connected onto the PCB 31 obliquely. That is, when the door body 2 opens the cabinet body, the LED light 32 is arranged obliquely towards the interior of the cabinet body, such that the LED light 32 can light the interior of the cabinet body better, a user can put the foods or goods to be frozen or refrigerated in the cabinet body or take out the foods or goods in the cabinet body conveniently.

In an embodiment of the present disclosure, the refrigerating apparatus 100 further includes a delay device (not shown in the figures) connected with the LED light 32. Optionally, the delay device is configured to be a capacitor and the capacitor is connected onto the PCB 31. In an example of the present disclosure, the capacitor is connected onto the PCB 31 and is connected with the LED light 32 in series. When the door body 2 closes the cabinet body, the gravity switch 33 is switched off, and the capacitor discharges so that the LED light can keep lighting for a period of time such as 1 s to 2 s after being turned off.

Optionally, a plurality of the LED lights 32 is spaced apart from one another on the PCB 31. Further, the plurality of the LED lights 32 is arranged in two rows in a direction of the PCB 31 parallel to the pivot shaft 421, and the two rows of the LED lights 32 are in a one-to-one or staggered arrangement. In the example of FIG. 1 to FIG. 3, six LED lights 32 are shown and are arranged in two rows in a length direction of the PCB 31, there are three LED lights 32 in every row and the two rows of the LED lights 32 are in the one-to-one arrangement. In the example of FIG. 4, eight LED lights 32 are shown and are arranged in two rows in the length direction of the PCB 31, there are four LED lights 32 in every row and the two rows of the LED lights 32 are in the one-to-one arrangement. It should be understood that, a number and an arrangement method of the LED light 32 may be provided according to an actual demand so as to meet the actual demand better.

In an embodiment of the present disclosure, a plurality of light assemblies 3 is arranged on the door body 2 and spaced apart from one another (not shown in the figures). In an example of the present disclosure, the door body 2 is formed with a plurality of accommodating grooves therein and the plurality of light assemblies 3 is spaced in the plurality of accommodating grooves, then a plurality of the cover bodies is covered on the corresponding plurality of light assemblies 3 respectively. Certainly, the present disclosure is not construed to this, the door body 2 may be also formed with only one accommodating groove and all of the plurality of light assemblies 3 is mounted in the accommodating groove, herein the plurality of light assemblies 3 may be covered by only one cover body.

Optionally, the door body 2 has an angle relative to an upper surface of the cabinet body ranging from 0° to 90°. That is, when the door body 2 is in the closed state, the door body 2 is parallel to the upper surface of the cabinet body and the angle between the door body 2 and the upper surface of the cabinet body is 0°; when the door body 2 is in the open state, a certain angle is formed between the door body 2 and the upper surface of the cabinet body and the angle is less than or equal to 90°, such that the light on the door body 2 can shine in the interior of the cabinet body better.

In an embodiment of the present disclosure, as shown in FIG. 1, FIG. 2, FIG. 5, FIG. 7 to FIG. 10, the door body 2 is rotatably disposed on the cabinet body via a hinge device 4, in which the hinge device 4 includes a first hinge 41 disposed on the top of the cabinet body and having a pivoting hole 4111 and a second hinge 42 disposed at the door body 2 and having the pivot shaft 421, in which the pivot shaft 421 cooperates with the pivoting hole 4111 so that the door body 2 pivots on the pivot shaft 421, and the second hinge 42 cooperates with the first hinge 41 via a limiting structure so that the door body 2 pivots on the cabinet body from 0° to 90°.

Specifically, the first hinge 41 is connected to the top of the cabinet body, the second hinge 42 is connected with the first end of the door body 2 (such as the lower end shown in FIG. 1 and FIG. 2), and the first hinge 41 and the second hinge 42 are pivotally connected together via the pivot shaft 421, thus the door body 2 can pivot on the pivot shaft 421 relative to the cabinet body around.

Figure 7:
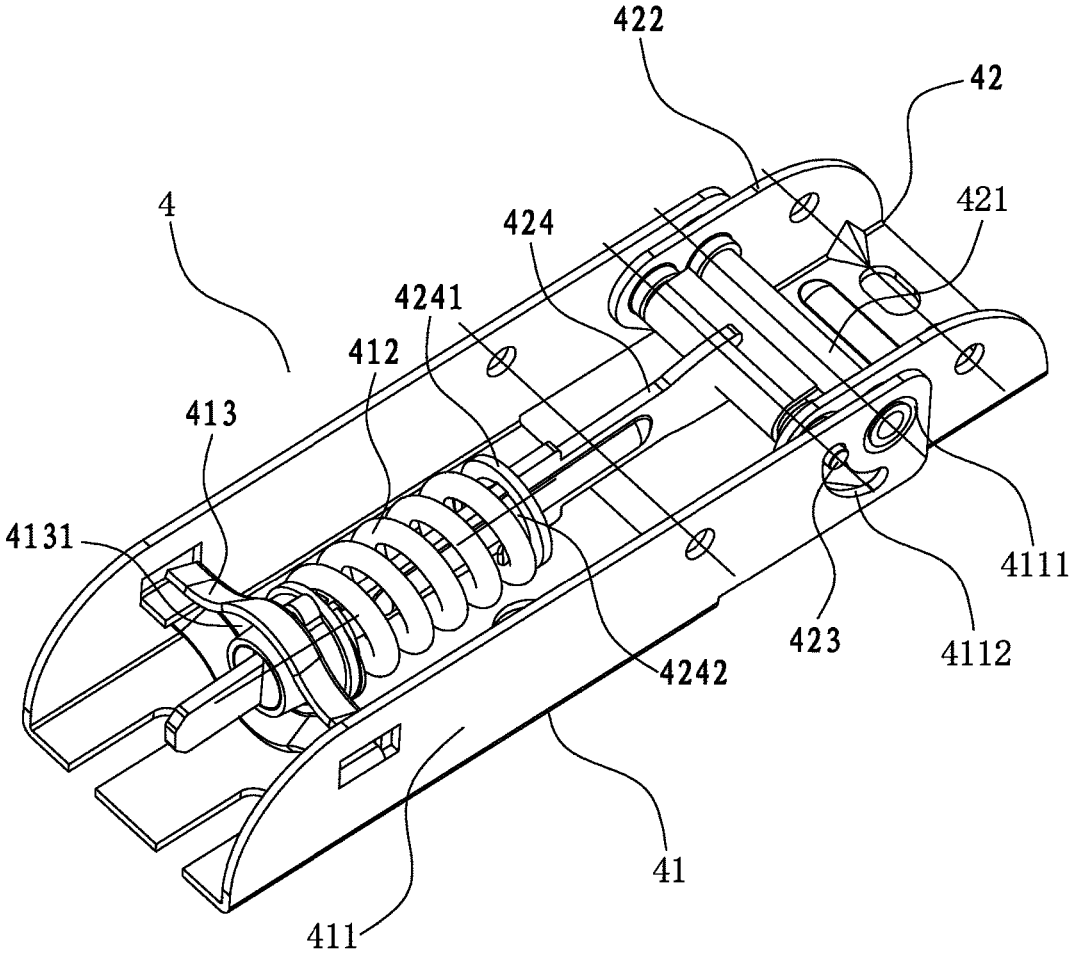
FIG. 7 is a perspective view of a hinge device of the refrigerating apparatus according to an embodiment of the present disclosure.
Figure 8:
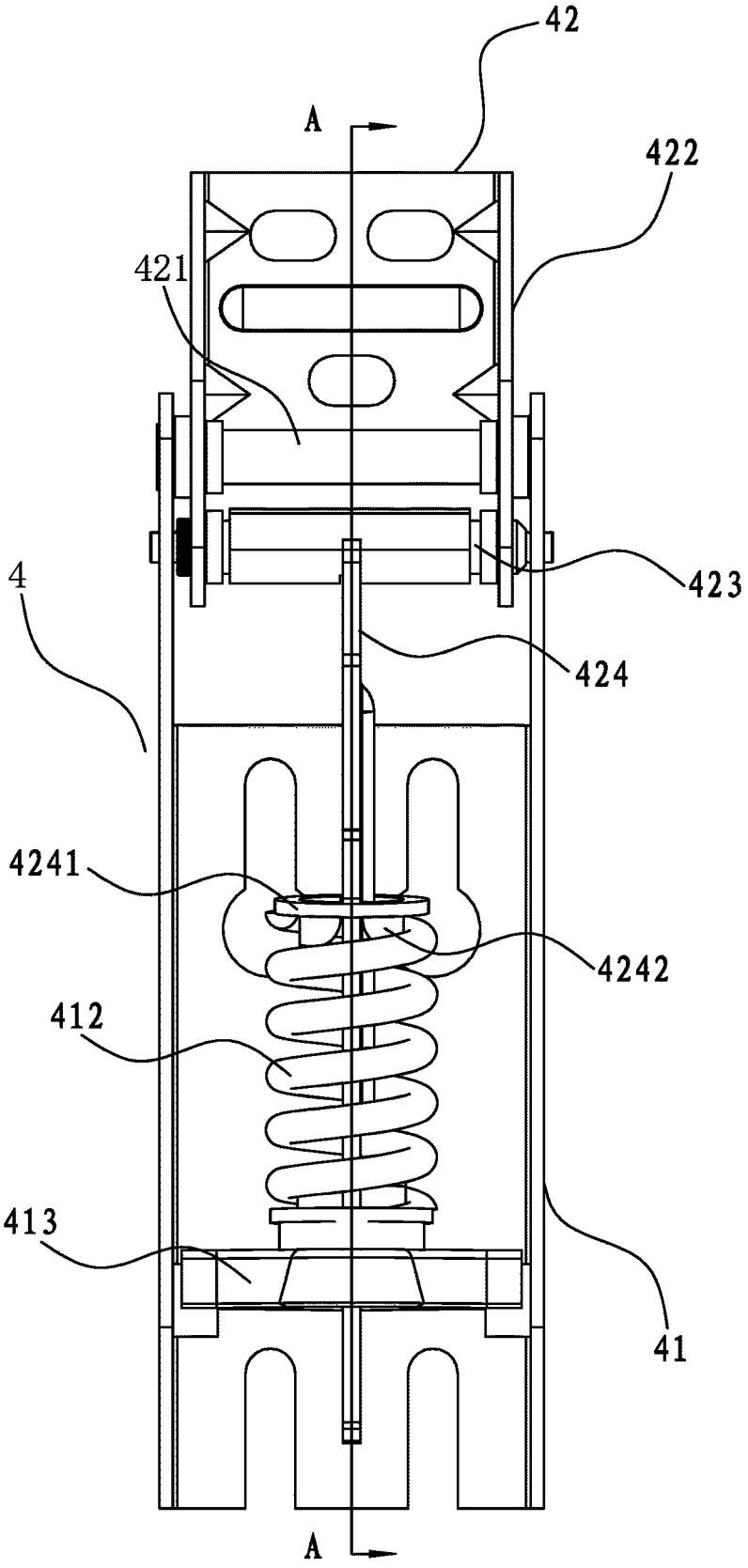
FIG. 8 is a front view of the hinge device shown in FIG. 7.

Optionally, as shown in FIG. 7 and FIG. 8 the first hinge 41 includes two side walls 411 spaced apart from each other, two pivoting holes 4111 are formed in the two side walls 411 respectively, and the pivot shaft 421 has two ends penetrating the two pivoting holes 4111 respectively. In an example of the present disclosure, two pivoting holes 4111 penetrate through the corresponding side walls 411 respectively, the second hinge 42 includes two hinge walls 422 spaced apart from each other, and the two hinge walls 422 are formed with through hinge holes respectively. When the hinge holes and the pivoting holes 4111 are corresponded, the pivot shaft 421 may penetrate the hinge holes and the pivoting holes 4111, such that the first hinge 41 and the second hinge 42 are assembled in place and can pivot on the pivot shaft 421.

Figure 10:
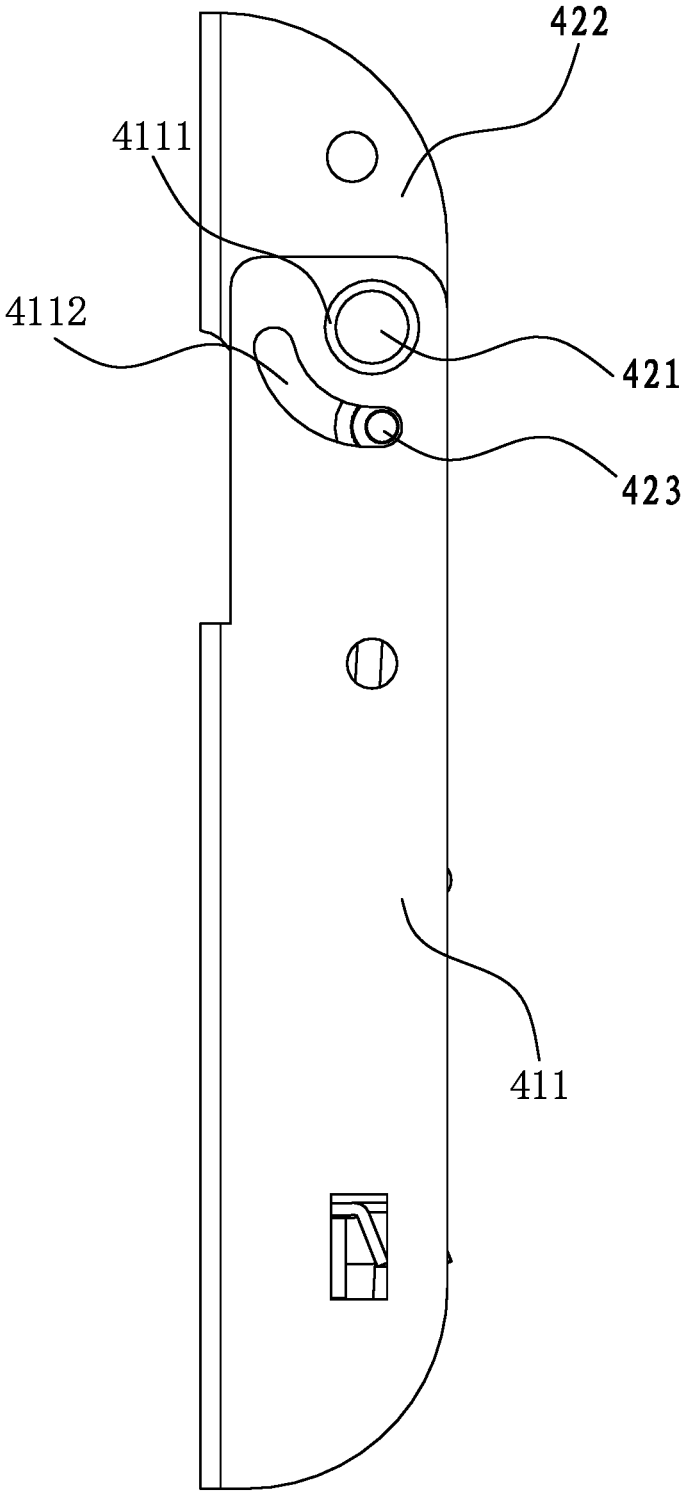
FIG. 10 is a side view of the hinge device shown in FIG. 7.

Specifically, referring to FIG. 10, the limiting structure includes a first limiting piece disposed to the first hinge 41, and a second limiting piece disposed to the second hinge 42 and cooperating with the first limiting piece so that the second hinge 42 pivots on the pivot shaft 421 from 0° to 90° relative to the first hinge 41.

As shown in FIG. 7, FIG. 8 and FIG. 10, the first limiting piece is configured to be a limiting hole 4112 and two limiting holes 4112 are provided in the two side walls 411 respectively, and the second limiting piece is configured to be a limiting column 423 and the limiting column 423 has two ends penetrating the two limiting holes 4112 respectively. Further, the limiting hole 4112 is configured to be an arc hole, the limiting hole 4112 and the pivot shaft 421 are arranged coaxially, and a central line of the arc hole is formed as a one-fourth arc having a center coinciding with the central axis of the pivot shaft. The two limiting holes 4112 are arranged correspondingly in the two side walls 411, the limiting column 423 may be disposed through the two hinge walls 422 of the second hinge 42, and the limiting column 423 and the pivot shaft 421 are spaced apart from each other. When the first hinge 41 and the second hinge 42 are assembled, the limiting column 423 may move back and forth in the limiting hole 4112. As the limiting hole 4112 is formed as the one-fourth arc, the second hinge 42 can pivot relative to the first hinge 41 at most at 90°, therefore the door body 2 can only pivot on the cabinet body between 0° to 90°.

Figure 9:
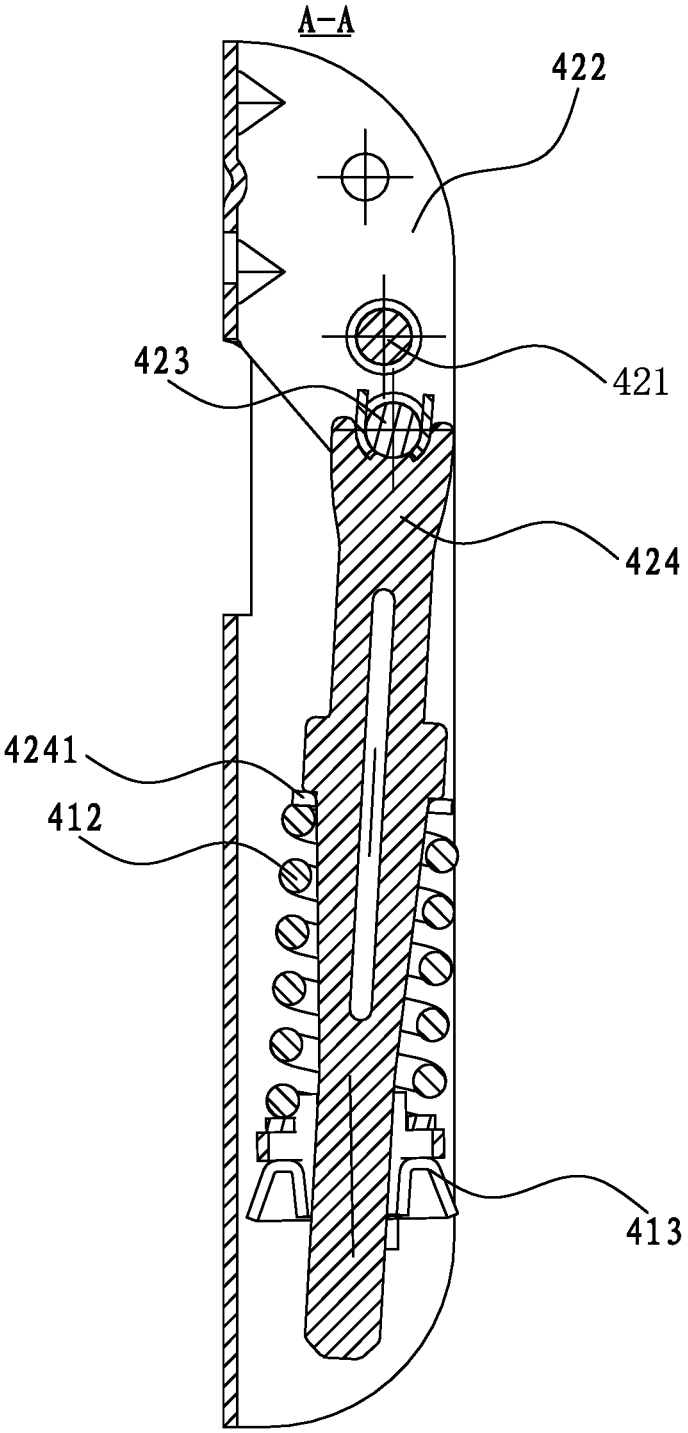
FIG. 9 is a section view along line A-A in FIG. 8.

In an embodiment of the present disclosure, referring to FIG. 8 and FIG. 9, a supporting structure is disposed between the first hinge 41 and the second hinge 42, and the supporting structure includes a spring 412, a supporting piece 424 and a supporting plate 4241. The spring 412 has a first end away from the limiting column 423 connected into the first hinge 41, the supporting piece 424 has a first end penetrating the spring 412 and a second end connected with the limiting column 423, and the supporting plate 4241 is disposed onto the supporting piece 424 and has a side surface adjacent to the spring 412 abutting against a second end of the spring 412 adjacent to the limiting column 423.

As shown in FIG. 8 and FIG. 9, the spring 412 is disposed between the two side walls 411 of the first hinge 41. Optionally, the first hinge 41 is provided with a base 413 therein and the first end of the spring 412 away from the limiting column 423 is connected onto the base 413. The supporting piece 424 may be a supporting rod, the base 413 may be formed with a through supporting hole 4131, and the supporting rod has a first end fixedly connected with the limiting column 423 and a second end penetrating the spring 412, the supporting hole 4131 successively. The supporting rod is provided a supporting plate 4241 thereon, the supporting plate 4241 is substantially a circular plate, and a lateral dimension of the supporting plate 4241 may be larger than a lateral dimension of the spring 412 and the supporting plate 4241 is disposed at a second end of the spring 412 adjacent to the limiting column 423. When the first hinge 41 and the second hinge 42 are assembled and in a process of a relative rotation between the first hinge 41 and the second hinge 42, the spring 412 can stay in a compressed state at all times. When the door body 2 opens the cabinet body, the spring 412 will apply a force to the supporting plate 4241 upwards so that the supporting piece 424 can support the limiting column 423 and position the limiting column 423 in a certain position of the positioning hole 4112, in this way, when the door body 2 pivots on the cabinet body at no more than 90°, by disposing the supporting structure, the door body 2 can be prevented from falling under an action of its gravity effectively if the user does not support the door body 2.

When the hinge device 4 is assembled, the second hinge 42 is connected with the door body 2 and pivots on the pivot shaft 421, and the movement of the second hinge 42 is limited within the limiting hole 4112. When the second hinge 42 pivots to a certain place adjacent to a center position of the limiting hole 4112, the supporting piece 424 transfers the elastic force of the spring 412 to the second hinge 42, which can overcame the gravity of the door body 2 so that the door body 2 will not fall.

Further, as shown in FIG. 7 and FIG. 8, the side surface of the supporting plate 4241 adjacent to the spring 412 is provided with a positioning column 4242 and the spring 412 is fitted over the positioning column 4242. Thus, the spring 412 can be positioned and guaranteed to be elongated or shortened in the axial direction thereof. Optionally, the positioning column 4242 and the supporting plate 4241 are formed integrally.

Reference throughout this specification to "an embodiment," "some embodiments," "an example," "a specific example," or "some examples," means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A refrigerating apparatus, comprising:

a cabinet body having an open top;

a door body disposed at the top of the cabinet body pivotably around a pivot shaft so as to open and close the cabinet body; and a light assembly, disposed at a side of the door body facing the cabinet body and arranged adjacent to the pivot shaft, wherein the light assembly comprises a PCB, an LED light and a gravity switch, both the LED light and the gravity switch are connected onto the PCB, and the gravity switch is configured to be switched on to light the LED light so as to light an interior of the cabinet body when the door body opens the cabinet body, and switched off to extinguish the LED light when the door body closes the cabinet body, wherein the gravity switch comprises:

a casing connected onto the PCB;

a first leading wire disposed through the casing and separated from the casing, wherein the first leading wire is connected onto the PCB; and a rolling body rollingly disposed in the casing and configured as that the LED light is turned on when the door body opens the cabinet body and the rolling body is in contact with the first leading wire, and the LED light is turned off when the door body closes the cabinet body and the rolling body is separated from the first leading wire, wherein the casing is connected onto the PCB through a second leading wire, and the second leading wire and the first leading wire are spaced apart from each other in a length direction of the casing.

2. The refrigerating apparatus according to claim 1, wherein a central axis of the casing along the length direction thereof is perpendicular to a central axis of the pivot shaft, and the first leading wire is disposed adjacent to the pivot shaft.

3. The refrigerating apparatus according to claim 1, wherein the first leading wire is separated from the casing via a separating piece and the separating piece is disposed between the first leading wire and the casing.

4. The refrigerating apparatus according to claim 1, further comprising:

a cover body covering the light assembly.

5. The refrigerating apparatus according to claim 4, wherein the LED light penetrates the cover body, the cover body is provided with a light-cover thereon, and the light-cover is arranged adjacent to the LED light.

6. The refrigerating apparatus according to claim 1, further comprising:

a light-cover arranged adjacent to the LED light and located at a first side of the LED light away from the pivot shaft.

7. The refrigerating apparatus according to claim 1, wherein the LED light has a second side facing the pivot shaft and connected onto the PCB obliquely.

8. The refrigerating apparatus according to claim 1, further comprising:

a delay device connected with the LED light.

9. The refrigerating apparatus according to claim 8, wherein the delay device is configured to be a capacitor and the capacitor is connected onto the PCB.

10. The refrigerating apparatus according to any one of claim 1, wherein a plurality of the LED lights is spaced apart from one another on the PCB.

11. The refrigerating apparatus according to claim 1, wherein the door body has an angle relative to an upper surface of the cabinet body ranging from 0° to 90°.

12. The refrigerating apparatus according to claim 11, wherein the door body is rotatably disposed on the cabinet body via a hinge device, and the hinge device comprises:

a first hinge disposed on the top of the cabinet body and having a pivoting hole; and a second hinge disposed at the door body and having the pivot shaft, wherein the pivot shaft cooperates with the pivoting hole so that the door body pivots about the pivot shaft, and the second hinge cooperates with the first hinge via a limiting structure so that the door body pivots relative to the cabinet body from 0° to 90°.

13. The refrigerating apparatus according to claim 12, wherein the first hinge comprises two side walls spaced apart from each other, two pivoting holes are formed in the two side walls respectively, and the pivot shaft has two ends passing through the two pivoting holes respectively.

14. The refrigerating apparatus according to claim 13, wherein the limiting structure comprises:

a first limiting piece disposed to the first hinge; and a second limiting piece disposed to the second hinge and cooperating with the first limiting piece so that the second hinge pivots about the pivot shaft from 0° to 90° relative to the first hinge.

15. The refrigerating apparatus according to claim 14, wherein the first limiting piece is configured to be a limiting hole and two limiting holes are provided in the two side walls respectively, and the second limiting piece is configured to be a limiting column and the limiting column has two ends passing through the two limiting holes respectively.

16. The refrigerating apparatus according to claim 15, wherein the limiting hole is configured to be an arc hole and the limiting hole is arranged coaxially with the pivot shaft.

17. The refrigerating apparatus according to claim 15, wherein a supporting structure is disposed between the first hinge and the second hinge, and the supporting structure comprises:

a spring having a first end away from the limiting column connected into the first hinge;

a supporting piece having a first end penetrating the spring and a second end connected with the limiting column; and a supporting plate disposed onto the supporting piece and having a side surface adjacent to the spring abutting against a second end of the spring adjacent to the limiting column.

18. The refrigerating apparatus according to claim 1, wherein a plurality of light assemblies is arranged on the door body and spaced apart from one another.

* * * * *